US012082627B2

(12) United States Patent
Melendez et al.

(10) Patent No.: US 12,082,627 B2
(45) Date of Patent: Sep. 10, 2024

(54) SHAPING GARMENT WITH ADJUSTABLE LOW BACK

(71) Applicant: Spanx, LLC, Atlanta, GA (US)

(72) Inventors: Angelica Melendez, Atlanta, GA (US); Jennifer Johnson, Atlanta, GA (US); Elena Novosiolova, Atlanta, GA (US)

(73) Assignee: Spanx, LLC, Atlanta, GA (US)

( * ) Notice: Subject to any disclaimer, the term of this patent is extended or adjusted under 35 U.S.C. 154(b) by 653 days.

(21) Appl. No.: 17/125,241

(22) Filed: Dec. 17, 2020

(65) Prior Publication Data

US 2021/0177072 A1 Jun. 17, 2021

Related U.S. Application Data

(63) Continuation of application No. 15/964,942, filed on Apr. 27, 2018, now Pat. No. 10,881,152.

(60) Provisional application No. 62/492,650, filed on May 1, 2017.

(51) Int. Cl.

| | |
|---|---|
| ***A41C 1/02*** | (2006.01) |
| ***A41B 9/08*** | (2006.01) |
| ***A41C 1/06*** | (2006.01) |
| ***A41C 3/08*** | (2006.01) |
| ***A41C 5/00*** | (2006.01) |

(52) U.S. Cl.

CPC ..... *A41C 1/02* (2013.01); *A41B 9/08* (2013.01); *A41C 1/06* (2013.01); *A41C 3/08* (2013.01); *A41C 5/005* (2013.01); *A41B 2400/38* (2013.01)

(58) Field of Classification Search

CPC .... A41C 1/02; A41C 1/06; A41C 3/08; A41C 5/005; A41B 9/08; A41B 2400/38

See application file for complete search history.

(56) References Cited

U.S. PATENT DOCUMENTS

| | | | |
|---|---|---|---|
| 1,531,814 | A | 3/1925 | Reynolds |
| 1,755,827 | A | 4/1930 | Waldemar |
| 1,891,775 | A | 12/1932 | Neilson |
| 1,927,018 | A | 9/1933 | Bloom |
| 1,944,591 | A | 1/1934 | Brown |
| 2,031,022 | A | 2/1936 | Wipperman |
| 2,107,121 | A | 2/1938 | Waldemar |

(Continued)

OTHER PUBLICATIONS

Non-Final Office Action received in connection with U.S. Appl. No. 15/965,019, dated Mar. 3, 2021, 7 pages.

(Continued)

*Primary Examiner* — Gloria M Hale

(74) *Attorney, Agent, or Firm* — Meunier Carlin & Curfman LLC

(57) ABSTRACT

Designing shapewear for special occasion garments with low cut necklines and back lines can be especially challenging. The challenge lies in constructing a garment that effectively shapes the wearer while simultaneously eliminating significant amounts of material from the chest and/or back region. Disclosed herein are shaping garments designed to be worn underneath garments with low cut back lines. The shaping garment includes a space in the back shaping region on its rear side, such that the shaping garment is not visible beneath an ultra low-back special occasion garment. A removable back adjuster can be used to bridge the space to provide additional shaping support when ultra low-back mode is not required by the special occasion garment.

19 Claims, 12 Drawing Sheets

(56) References Cited

U.S. PATENT DOCUMENTS

| | | | | |
|---|---|---|---|---|
| 2,279,222 | A * | 4/1942 | Bowman | A41D 7/00 2/67 |
| 2,579,547 | A | 12/1951 | Esther | |
| 2,598,172 | A | 5/1952 | Davis | |
| 2,634,417 | A | 4/1953 | Kaplan | |
| 2,668,954 | A | 2/1954 | Frohlich | |
| 2,678,446 | A | 5/1954 | Fellner | |
| 2,926,668 | A | 3/1960 | Schaumer | |
| 3,046,990 | A | 7/1962 | Wiedle | |
| 3,173,421 | A | 3/1965 | Steiner | |
| 3,191,603 | A | 6/1965 | Marino | |
| 3,332,426 | A | 7/1967 | Kaplan | |
| 3,411,509 | A | 11/1968 | Sachs | |
| 3,418,700 | A | 12/1968 | Irving | |
| 4,956,878 | A | 9/1990 | Boynton | |
| 6,766,533 | B1 | 7/2004 | Meier | |
| 6,811,462 | B1 * | 11/2004 | Kenneally | A41C 3/08 450/30 |
| 8,425,275 | B2 | 4/2013 | Noel | |
| 8,460,055 | B2 | 6/2013 | Cheng | |
| 8,574,026 | B2 * | 11/2013 | Livingstone | A41D 31/18 450/33 |
| 9,456,639 | B2 | 10/2016 | Aylward | |
| 9,936,739 | B2 | 4/2018 | Smith | |
| 10,448,679 | B1 | 10/2019 | Roddis et al. | |
| 10,660,373 | B2 | 5/2020 | Martin | |
| 10,881,152 | B2 * | 1/2021 | Melendez | A41C 1/06 |
| 10,959,465 | B2 | 3/2021 | Melendez | |
| 11,058,155 | B2 | 7/2021 | Roddis et al. | |
| 11,234,468 | B2 | 2/2022 | Melendez | |
| 2006/0276103 | A1 | 12/2006 | Teng | |
| 2007/0026767 | A1 | 2/2007 | Scheininger | |
| 2007/0079419 | A1 | 4/2007 | Srpuill | |
| 2007/0123148 | A1 | 5/2007 | Heer | |
| 2008/0134406 | A1 | 6/2008 | Shih et al. | |
| 2008/0194179 | A1 | 8/2008 | Leung | |
| 2009/0300816 | A1 | 12/2009 | Brito et al. | |
| 2010/0184355 | A1 | 7/2010 | Kennedy | |
| 2011/0003533 | A1 | 1/2011 | Caruso et al. | |
| 2011/0124268 | A1 | 5/2011 | Cheng | |
| 2011/0209262 | A1 | 9/2011 | Waldman et al. | |
| 2012/0060253 | A1 | 3/2012 | Bergin | |
| 2012/0149277 | A1 | 6/2012 | Moses-Jones | |
| 2014/0357159 | A1 | 12/2014 | Balland | |
| 2015/0101099 | A1 | 4/2015 | Zhong | |
| 2015/0147939 | A1 | 5/2015 | Chen | |
| 2016/0015090 | A1 | 1/2016 | Mazourik | |
| 2016/0135512 | A1 | 5/2016 | Smith | |
| 2016/0150833 | A1 | 6/2016 | Spicer | |
| 2016/0157529 | A1 | 6/2016 | Hoeven | |
| 2016/0182602 | A1 | 6/2016 | Cordonnier | |
| 2016/0235129 | A1 | 8/2016 | Jackson | |
| 2018/0116306 | A1 | 5/2018 | Andre | |
| 2019/0320738 | A1 | 10/2019 | Kiuchi et al. | |
| 2019/0330773 | A1 | 10/2019 | Allen et al. | |
| 2020/0107587 | A1 | 4/2020 | Martin | |
| 2020/0323278 | A1 | 10/2020 | Roddis et al. | |

OTHER PUBLICATIONS

Non-Final Office Action received in connection with U.S. Appl. No. 15/965,019, dated Jan. 28, 2020, 13 pages.

Office Action issued for U.S. Appl. No. 17/588,923, dated Sep. 13, 2023.

Notice of Allowance issued for U.S. Appl. No. 17/588,923, dated Feb. 5, 2024.

* cited by examiner

SHAPING GARMENT WITH ADJUSTABLE LOW BACK

CROSS-REFERENCE TO RELATED APPLICATIONS

This application is a continuation of U.S. application Ser. No. 15/964,942, filed Apr. 27, 2018, which claims the benefit of U.S. Provisional Application 62/492,650, filed May 1, 2017. Each of the aforementioned applications is incorporated by reference in its entirety for all purposes.

BACKGROUND

Special occasions often lead to the purchase of unique garments that may only be used once or a few times. These garments can have interesting necklines, back lines, breast padding, and long, embellished skirts and underskirts that add weight to the garment. Shaping garments can be worn under the special occasion garment to smoothen and shape the wearer's overall silhouette. Designing shaping garments for special occasion garments can be especially challenging because it should be versatile enough to adapt to the many types of unique features that special occasion garments can include.

SUMMARY

Designing shapewear for special occasion garments with low cut necklines and back lines can be especially challenging. The challenge lies in constructing a garment that effectively shapes the wearer while simultaneously eliminating significant amounts of material from the chest and/or back region. Disclosed herein are shaping garments designed to be worn underneath garments with low cut back lines. The shaping garment includes a space in the back shaping region on its rear side to ensure that the shaping garment is not visible beneath an ultra low-back special occasion garment. A removable back adjuster can be used to bridge the space in the rear side of the garment to provide additional shaping support when ultra low-back mode is not required by the special occasion garment.

Shaping garments disclosed herein have a superior edge that dips to a rear lowermost area on the rear side of the garment. The superior edge extends upward from the rear lowermost area, partially separating the rear side into left and right back shaping regions. The superior edge thereby defines a space between the left back shaping region and the right back shaping region. In some embodiments, a facing elastic can be positioned adjacent the superior edge on an interior side of the rear side of the garment. For example, a facing elastic can run along the portion of the superior edge that defines the space between the left back shaping region and the right back shaping region.

The shaping garments can also include left and right closure mechanisms on the rear side of the garment, and a removable back adjuster that bridges the space between the left and right back shaping regions. The removable back adjuster includes a first portion of the left closure mechanism and a first portion of the right closure mechanism. The first portions of the left and right closure mechanisms are configured to adjoin the back adjuster to the left and right back shaping regions (for example, via second portions of the left and right closure mechanisms that are attached to the left and right back shaping regions). In some embodiments, the left closure mechanism and/or the right closure mechanism can include hook and/or eye fasteners. The removable back adjuster can also include a highly elastic region, which can be positioned between the left closure mechanism and the right closure mechanism.

Some embodiments of the shaping garment can include left and right leg portions with seamless inferior edges.

Some embodiments of the shaping garments disclosed herein include at least one breast supporting portion positioned on a front side of the shaping garment. In some embodiments, left and right breast supporting portions each comprise a molded inner layers. The left and right breast supporting portions can also include a strip of supporting fabric positioned between the molded inner layer and an outer layer of fabric. An elastic band can be positioned inferior to the breast supporting portion, and the elastic band can extend laterally towards the rear side of the shaping garment. In some embodiments, the elastic band extends underneath an exterior layer of the shaping garment. In some embodiments, the elastic band extends to the rear side of the shaping garment underneath the exterior layer of the left back shaping region and the exterior layer of the right back shaping region. A lateral elastic band seam can laterally across a superior region of the elastic band, attaching the elastic band to an exterior layer of the shaping garment. An inferior region of the elastic band can remain unattached to the exterior layer of the shaping garment.

In some embodiments, the elastic band can include the second portions of the left and right closure mechanisms, which are configured to attach to the first portions of the left and right closure mechanisms positioned on the removable back adjuster. As such, the elastic band is configured to attach to the removable back adjuster. In some embodiments, the elastic band includes left and right eye sets and the removable back adjuster comprises left and right hook sets. The hook sets can curve outward and toward an exterior surface of the removable back adjuster.

In some embodiments, a superior edge of the shaping garment includes a front lowermost area positioned on a front side of the shaping garment. The superior edge extends upward from the front lowermost area. This at least partially separates the front side of the garment into a left breast supporting portion and a right breast supporting portion and defines a space between the left and right breast supporting portions. In some embodiments, the superior edge defines a U-shaped space as it progressively diverges extending upward from the front lowermost area. The edge defining the U-shaped space can be attached to a U-shaped wire. The U-shaped wire can be enclosed in a wire casing. In some embodiments, left and right portions of an elastic band are affixed to the U-shaped wire. The left and right portions of the elastic band extends toward the rear side of the shaping garment. The left portion of the elastic band can include a portion of a left closure mechanism and the right portion of the elastic band can include a portion of the right closure mechanism, such that the elastic band is configured to attach to a removable back adjuster.

In some embodiments, a front side the shaping garment further can also include left and right front shaping regions. At least one shoulder strap can extend from one of the front shaping regions toward the opposite front shaping region, or toward the rear side of the shaping garment. In some embodiments, the shoulder strap(s) are removably connectable to shoulder strap tabs positioned near the superior edge of the shaping garment. In an embodiment, one shoulder strap can extend from the left front shaping region to the right front shaping region, such that the shaping garment can be worn in a halter configuration.

Methods of making shaping garments are also disclosed herein. The method of making can include cutting a left rear panel from a fabric sheet such that the left rear panel narrows as it extends toward a superior portion of the left panel, creating a narrowing left superior rear portion. The method can further include cutting a right rear panel from a fabric sheet such that the right rear panel narrows as it extends toward a superior portion of the right panel, creating a narrowing right superior rear portion. The method can further include attaching a portion of a left closure mechanism to the right edge of the narrowing left superior rear portion, and attaching a portion of a right closure mechanism to the left edge of the narrowing right superior rear portion. The right inferior edge of the left rear panel can be sewn to a left inferior edge of the right rear panel to form a rear side of the shaping garment. The narrowing left superior rear portion and the narrowing right superior rear portion can remain unattached, thereby defining the space in the rear side of the shaping garment. The method can also include sewing the rear side of the shaping garment to a front panel of the garment to form a front side of the shaping garment. A removable back adjuster can be attached to the left and right closure mechanisms to bridge the space on the rear side of the shaping garment.

Some embodiments of the methods can include attaching a left facing elastic to the superior portion of the left rear panel adjacent the space on the rear side of the shaping garment and attaching a right facing elastic to the superior portion of the right rear panel adjacent the space on the rear side of the shaping garment.

In some embodiments, at least one elastic band can be attached along an interior, superior edge of the rear side of the shaping garment. Some embodiments of the methods can include extending a left elastic band from the rear interior side of the shaping garment to the front side of the shaping garment, and extending a right elastic band from the rear interior side of the shaping garment to the front side of the shaping garment. Some embodiments can include attaching the left elastic band to a U-shaped wire on the front side of the shaping garment, and attaching the right elastic band to the U-shaped wire on the front side of the shaping garment.

Some embodiments of the methods include attaching left and right breast supporting portions along a superior edge of the front side of the shaping garment. For example, a superior edge of at least one elastic band can be attached to an interior, superior edge of the front panel and to the inferior edges of the left and/or right breast supporting portion. A superior edge of the front panel can also be attached to a U-shaped wire, which can be attached to the elastic band and the left and/or right breast supporting portions.

panels curve outward and toward an exterior surface of the removable back adjuster.

DETAILED DESCRIPTION

Designing shapewear for special occasion garments with low cut necklines and back lines can be especially challenging. The challenge lies in constructing a garment that effectively shapes the wearer while simultaneously eliminating significant amounts of material from the chest and/or back region. Disclosed herein are shaping garments designed to be worn underneath garments with low cut back lines. The shaping garment includes a space in the back shaping region on its rear side, such that the shaping garment is not visible beneath an ultra low-back special occasion garment. A removable back adjuster can be used to bridge the space in the rear side of the garment to provide additional shaping support when ultra low-back mode is not required by the special occasion garment.

This description refers to certain aspects of the shaping garment relative to other aspects of the shaping garment or to the body of a wearer. As used herein, superior indicates a direction that is closer to the wearer's head. Inferior indicates a direction that is closer to the wearer's feet. Upward, upper, or uppermost indicates a superior direction, or toward a wearer's head. Downward and lower or lower most indicates an inferior direction, or toward a wearer's feet. The longitudinal direction refers to an axis extending between the superior and inferior edges of the garment, or between the wearer's head and feet. The terms right and left are in reference to the wearer's body. Lateral indicates a direction toward the wearer's sides, whereas medial indicates a direction toward the wearer's center. Some of the figures include the letters R and L as right and left directional indicators. Exterior refers to farther from the wearer's body, whereas interior and underneath refer to closer to the wearer's body.

Figure 1:
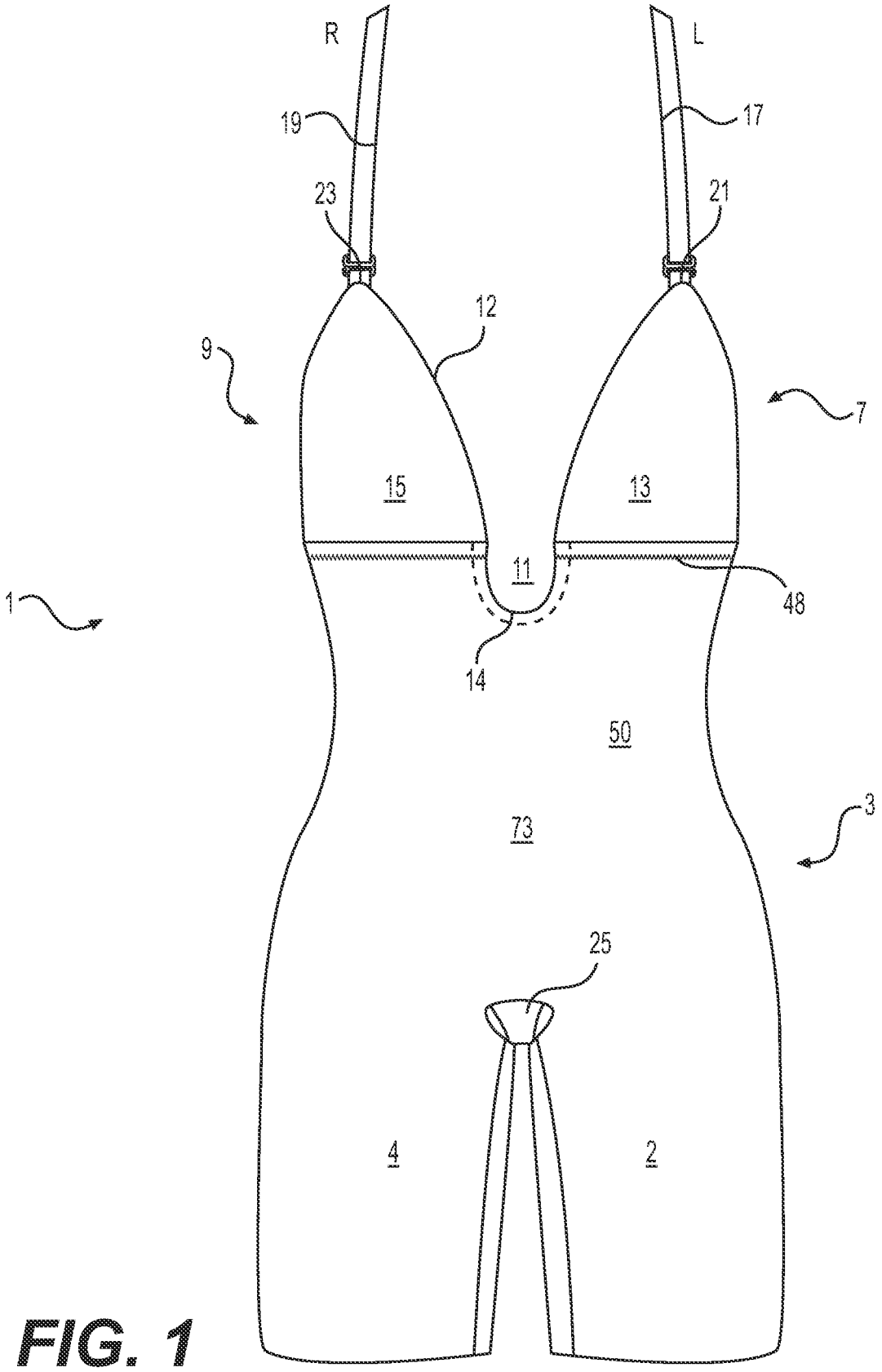
FIG. 1 illustrates a front view of the outside of a shaping garment.
Figure 2:
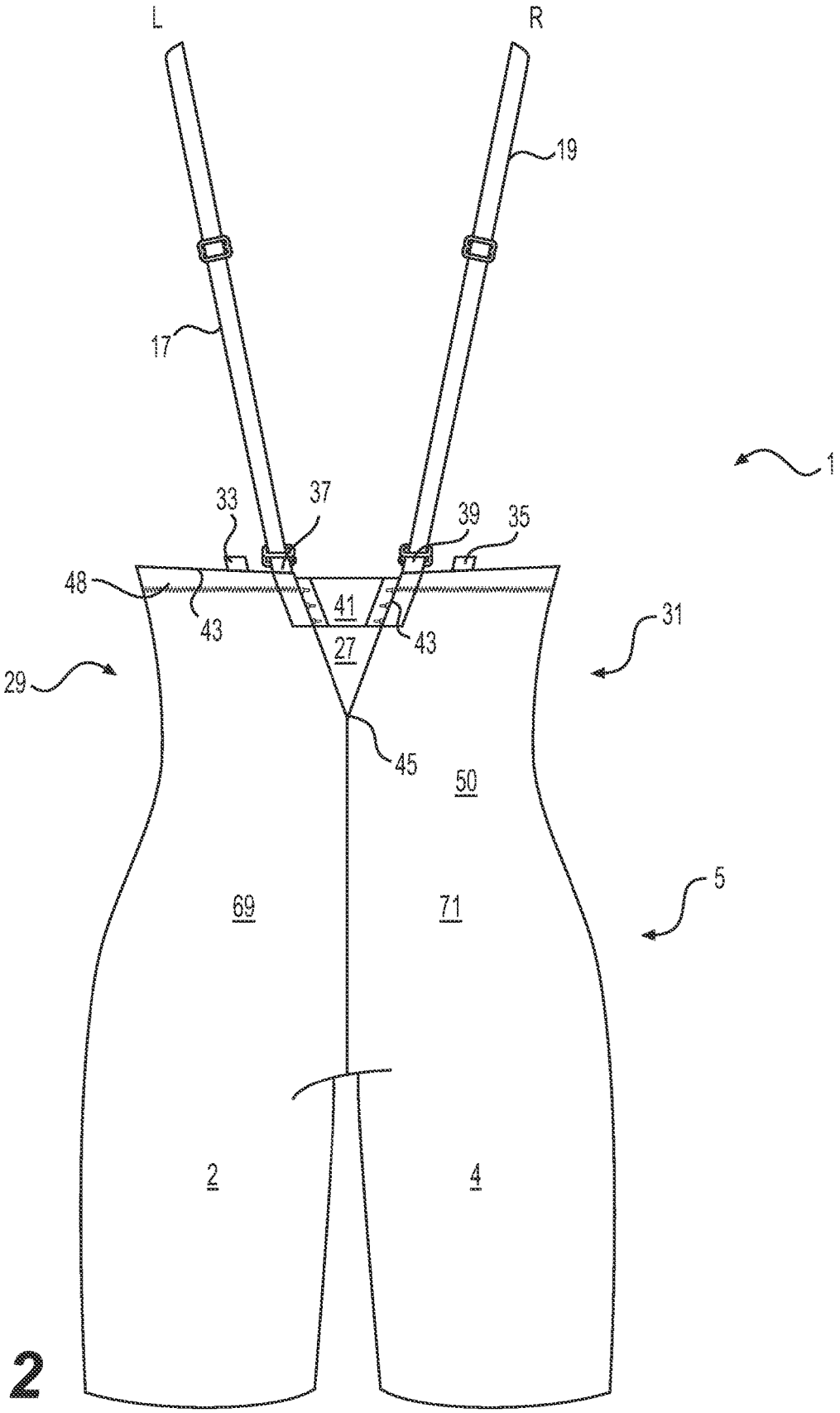
FIG. 2 illustrates a rear view of the outside of a shaping garment.

FIGS. 1 and 2 show front and back views, respectively, of one embodiment of the shaping garment 1 disclosed herein. As shown in FIGS. 1 and 2, the shaping garment 1 can be constructed as a bodysuit, with or without leg portions. The shaping garment 1 shown includes left and right leg portions 2, 4. Alternatively, the shaping garment 1 could be constructed as a bustier, without a crotch region or leg portions. Embodiments that include leg portions can have seamless inferior edges to reduce bulkiness and improve overall comfort to the wearer.

The shaping garment 1 embodiment shown includes front side 3 and rear side 5. On the front side 3 of this embodiment, left and right front shaping regions 7, 9 are partially separated from each other by a U-shaped space 11, which prevents the shaping garment 1 from being seen beneath a special occasion garment having a low neckline. The U-shaped space 11 is defined by the front superior edge 12 of the shaping garment 1. The front superior edge 12 extends upward from its front lowermost area 14, progressively diverging to define a space that widens in the superior direction. Some embodiments of the shaping garment 1 could instead have a V-shaped space, whereas other embodiments may have no space between the left and right front shaping regions 7, 9, forming instead a single breast supporting region with a superior edge closer to the neck of the wearer. Still other embodiments could have a general front side widening space that widens as it extends in the superior direction but that is a shape other than a U or a V. Other embodiments could have a space that ends abruptly such that the lower side of the space appears to be a portion of a square or a rectangle. For a square or rectangular space, the superior edge of the garment would extend horizontally along the lowermost area 14 and then rise at right angles and extend upward toward wearer's head.

As shown in the embodiment of FIG. 1, left and right front shaping regions 7, 9 can include left and right breast supporting portions 13, 15 positioned on either side of the U-shaped space 11. The left and right shaping regions 7, 9 can be attached, either permanently or non-permanently, to left and right shoulder straps 17, 19 at left and right front shoulder strap tabs 21, 23. In some embodiments, the shaping garment can include a specialized construction, or gusset 25, in the crotch region. The gusset material can be attached to the shaping garment 1, for example, by an overlock stitch. The gusset 25 can enable the user to use the bathroom without removing shaping garment 1. Specialized gussets 25 are described elsewhere, such as in U.S. Patent Application No. 62/491,756 and Ser. No. 15/964,516, which are incorporated by reference in their entireties. For example, the gusset can include an access space, or a void, in the garment 1, that enables the wearer to use the restroom without removing the garment 1. In some embodiments, the access space can be partially covered by two side cover panels that extend from the right and left leg portions inward to partially or completely cover the access space. The side cover panels can be formed seamlessly with other parts of the garment 1, or they can be fixedly attached, for example, by sewing or bonding. In some embodiments, the gusset can include a highly stretchable panel of material that extends from the front of the garment to the back, over the access space, in the crotch region. The highly stretchable panel of material may be included with or without the side cover panels. It can be formed seamlessly with other parts of the garment 1, or may be fixedly attached, for example, by sewing or bonding. The highly stretchable panel of material has a high degree of elongation and recovery, such that it can be moved with just one hand and easily put back into place when finished.

Referring now to FIG. 2, the rear side 5 of shaping garment 1 includes a V-shaped space 27, which partially separates the rear side 5 into left and right back shaping regions 29, 31. The V-shaped space 27 is defined by the superior edge 43 of the shaping garment 1, which progressively diverges as it extends upward from its rear lowermost area 45. While the embodiment shown has a V-shaped space 27, other embodiments of the shaping garment 1 could instead have a U-shaped space. Still other garments can have a space that generally widens as it extends in the superior direction on the rear side, creating a shape other than a U or a V. Other embodiments could have a space in the rear side of the garment that ends abruptly, such that the lower side of the space appears to be a portion of a square or a rectangle. For a square or rectangular space, the superior edge of the garment would extend horizontally along the lowermost area 45, and then rise at right angles and extend upward toward the wearer's head. As noted above, the space 27 in the rear side 5 of the shaping garment 1 prevents the shaping garment 1 from being seen underneath an ultra low-back special occasion garment. Some embodiments can include a facing elastic attached along the superior edge, adjacent the space 27 in the rear side of the garment. This facing elastic is shown as dotted lines around the space 27 in FIG. 4. The facing elastic helps to stabilize the space 27 and limit the extent that it stretches on the wearer's body.

Figure 7B:
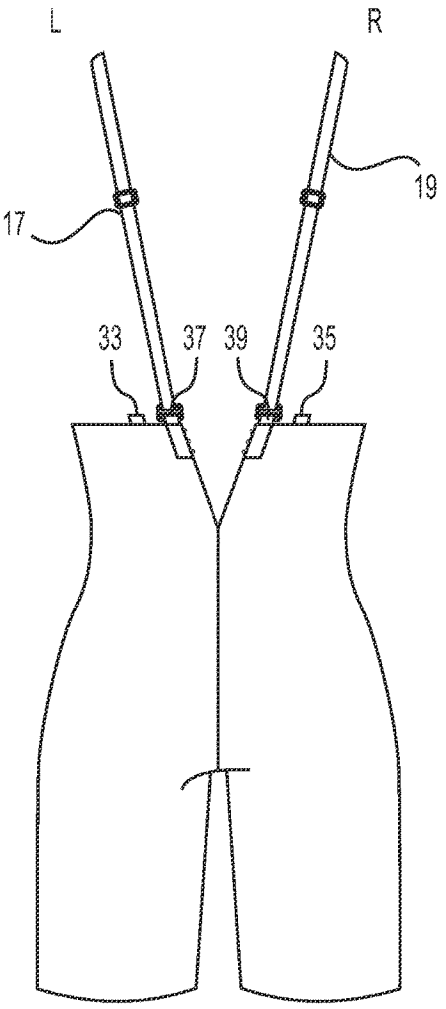
FIGS. 7A and 7B illustrate rear views of the shaping garment in ultra low-back mode with the shoulder straps in the narrow configuration.
Figure 7A:
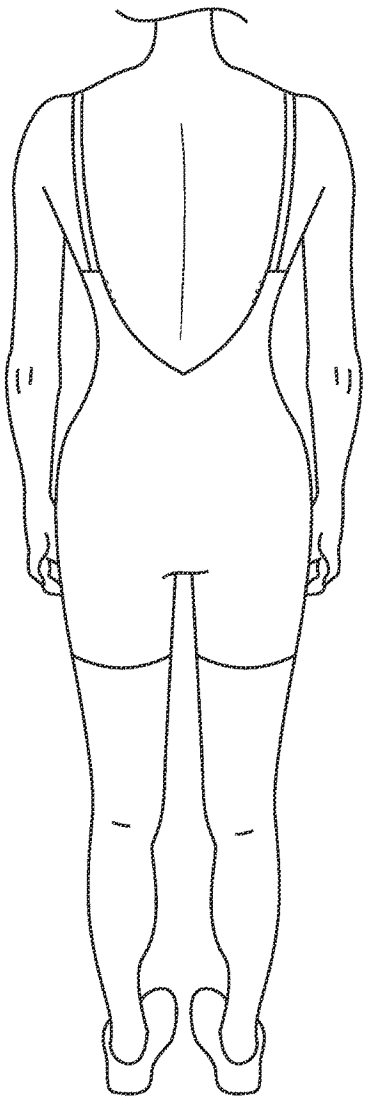
Figure 8B:
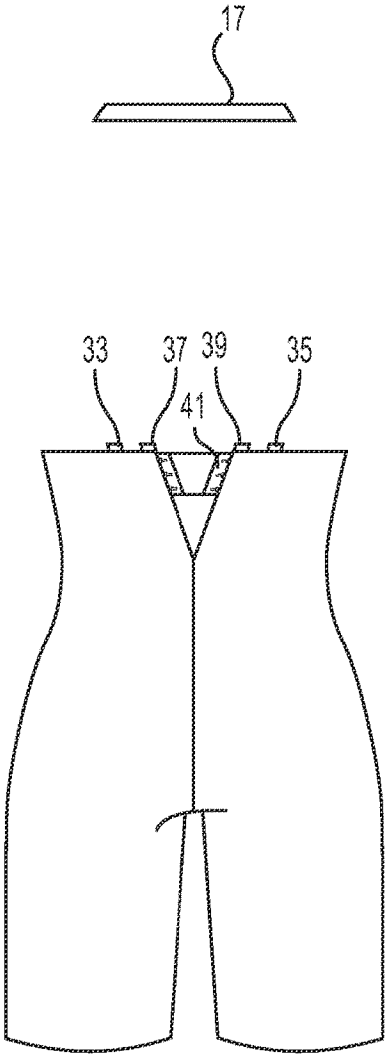
FIGS. 8A and 8B illustrate rear views of the shaping garment in low-back and with the shoulder straps in the halter configuration.
Figure 8A:
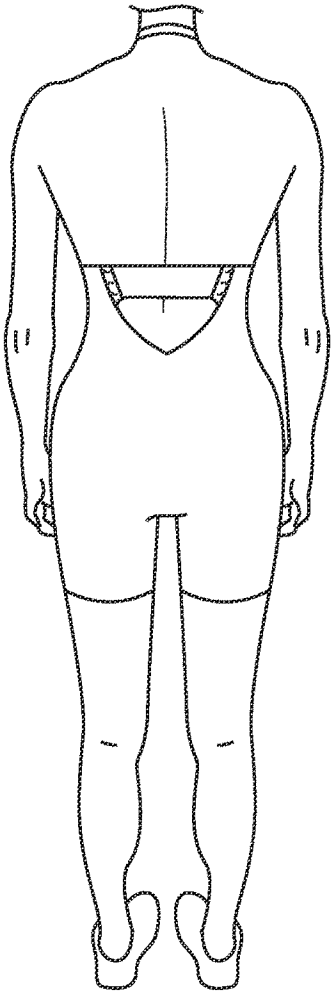
Figure 9B:
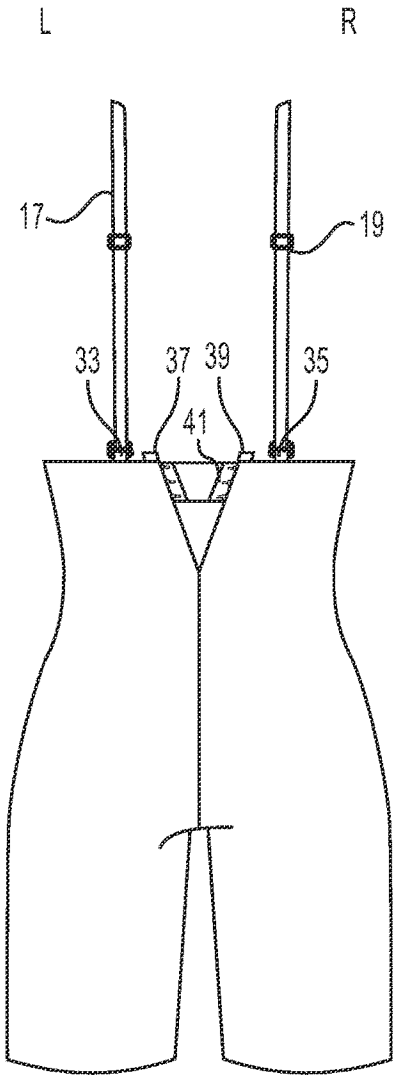
FIGS. 9A and 9B illustrate rear views of the shaping garment in low-back mode with the shoulder straps in a traditional configuration.
Figure 9A:
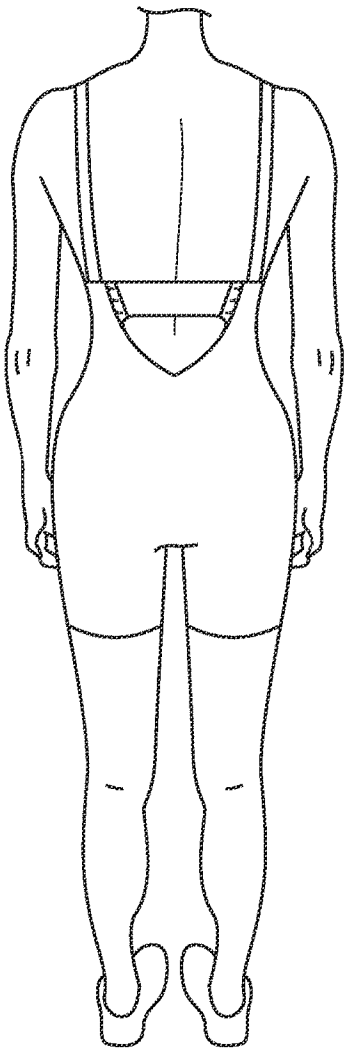
Figure 10:
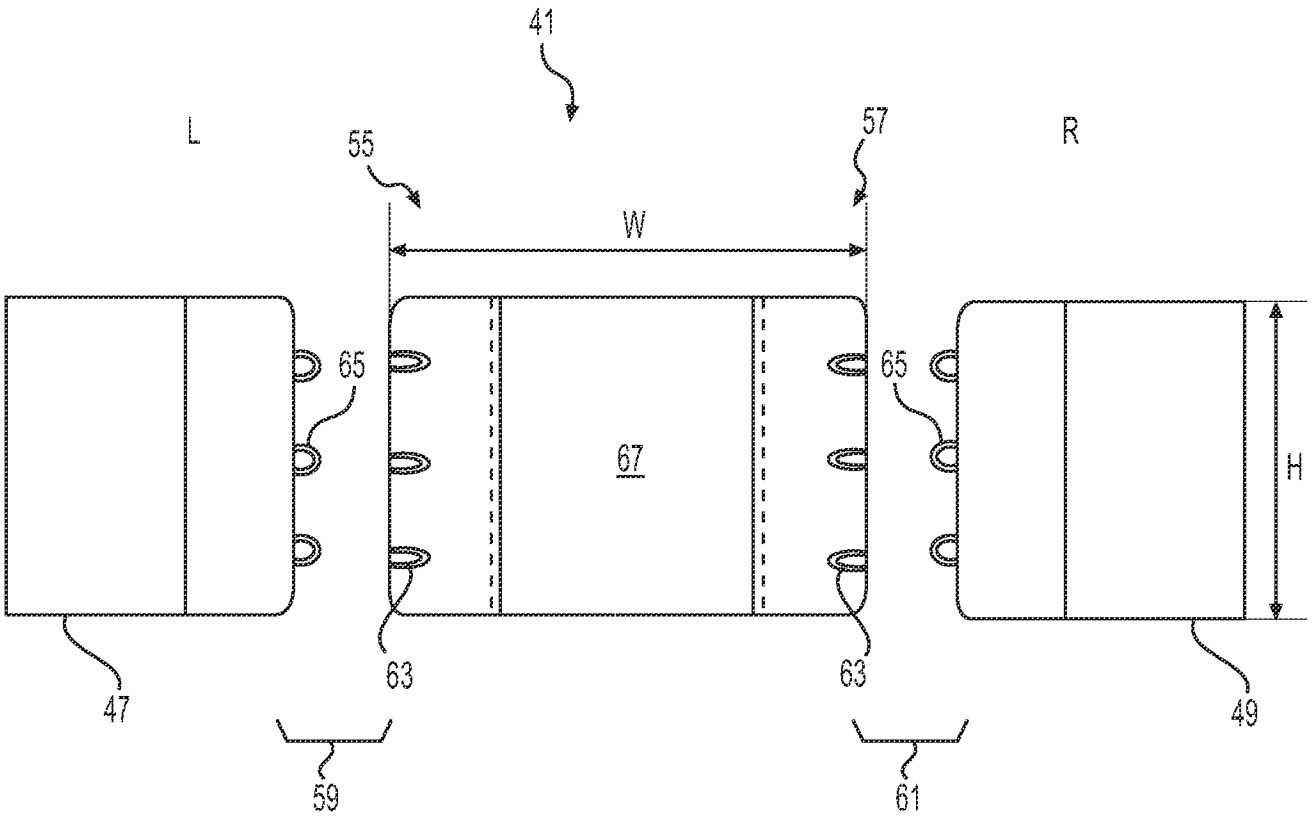
FIG. 10 illustrates a removable back adjuster and left and right portions of an elastic band.

The rear side 5 of the shaping garment 1 also includes a removable back adjuster 41, which can be reversibly attached to the shaping garment 1 to allow it to be worn in either in an ultra low-back mode (without the back adjuster 41 as shown, for example, in FIGS. 7A and 7B) or in a low-back mode (with the back adjuster 41 as shown, for example, in FIGS. 8A, 8B, 9A, and 9B). The removable back adjuster 41 is shown in FIG. 10 and described in greater detail below.

Figure 12:
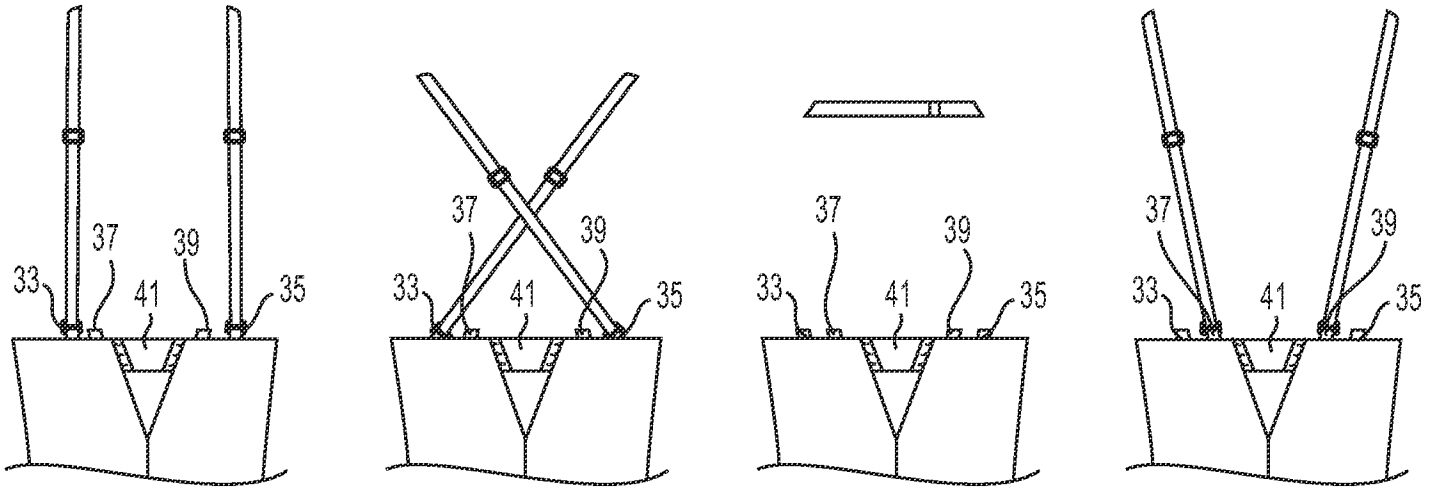
FIG. 12 illustrates a variety of different shoulder strap configurations.

Referring again to FIGS. 1 and 2, shoulder strap tabs 21, 23, 33, 35, 37 and 39 are positioned near the superior edges 12 and 43 of the shaping garment 1. Removably connectable left and right shoulder straps 17, 19 can extend from left and right front shoulder strap tabs 21, 23 to the rear side 5 of the garment, where they can be attached to rear shoulder strap tabs 33, 35, 37 and/or 39 at a variety of locations. For example, in this embodiment, there is an outer pair of left and right rear shoulder strap tabs 33, 35 and an inner pair of left and right rear shoulder strap tabs 37, 39. The inner pair of shoulder strap tabs 37, 39 are closer to the central back seam 32 than the outer pair of shoulder strap tabs 33, 35. In some embodiments, such as the halter mode shown in FIGS. 8A and B, a single shoulder strap 17 can extend from a left front shoulder strap tab 21 on the front shaping region 7 to a right front shoulder strap tab 23 on the right front shaping region 9, or vice versa. FIG. 12 demonstrates a variety of strap configurations, including traditional (utilizing the outer rear shoulder strap tabs 33, 35), criss-cross (utilizing either the outer rear shoulder strap tabs 33, 35, as shown, or the inner rear shoulder strap tabs 37, 39), halter (where a single shoulder strap 17 extends between the left front shaping region 7 and the right front shaping region 9 using only the front strap tabs 21, 23) or narrow (utilizing the inner rear shoulder straps tabs 37, 39). Though the removable back adjuster 41 is shown bridging the space 27 with all of the strap configurations of FIG. 12, it should be understood that it does not have to be worn with any of these strap configurations. The combined removability of the back adjuster 41 and the variety of shoulder strap configurations give the shaping garment 1 an even greater degree of versatility to adapt to the wide variety of special occasion garment styles.

Figure 3:
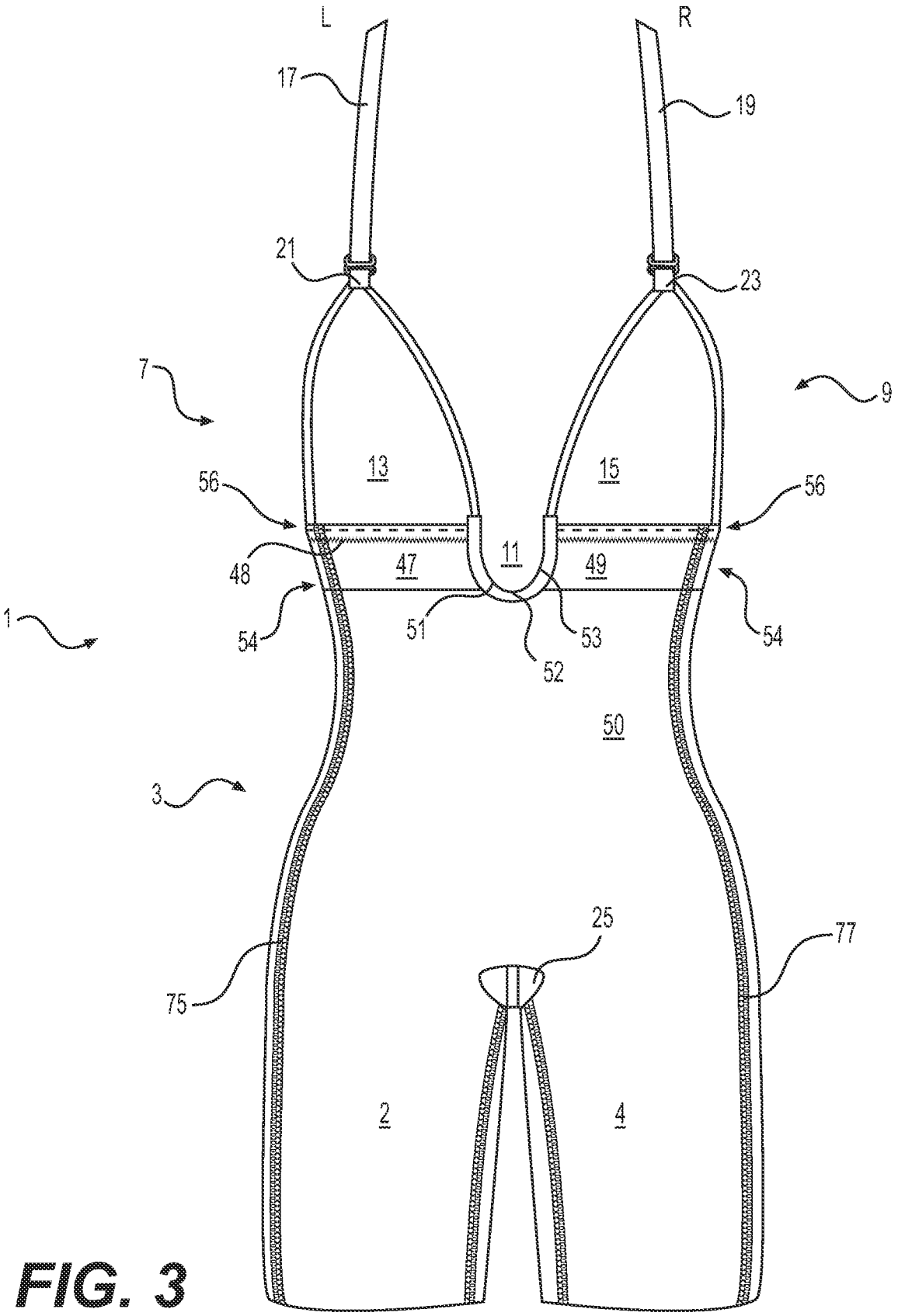
FIG. 3 illustrates a front view of the inside of a shaping garment.
Figure 4:
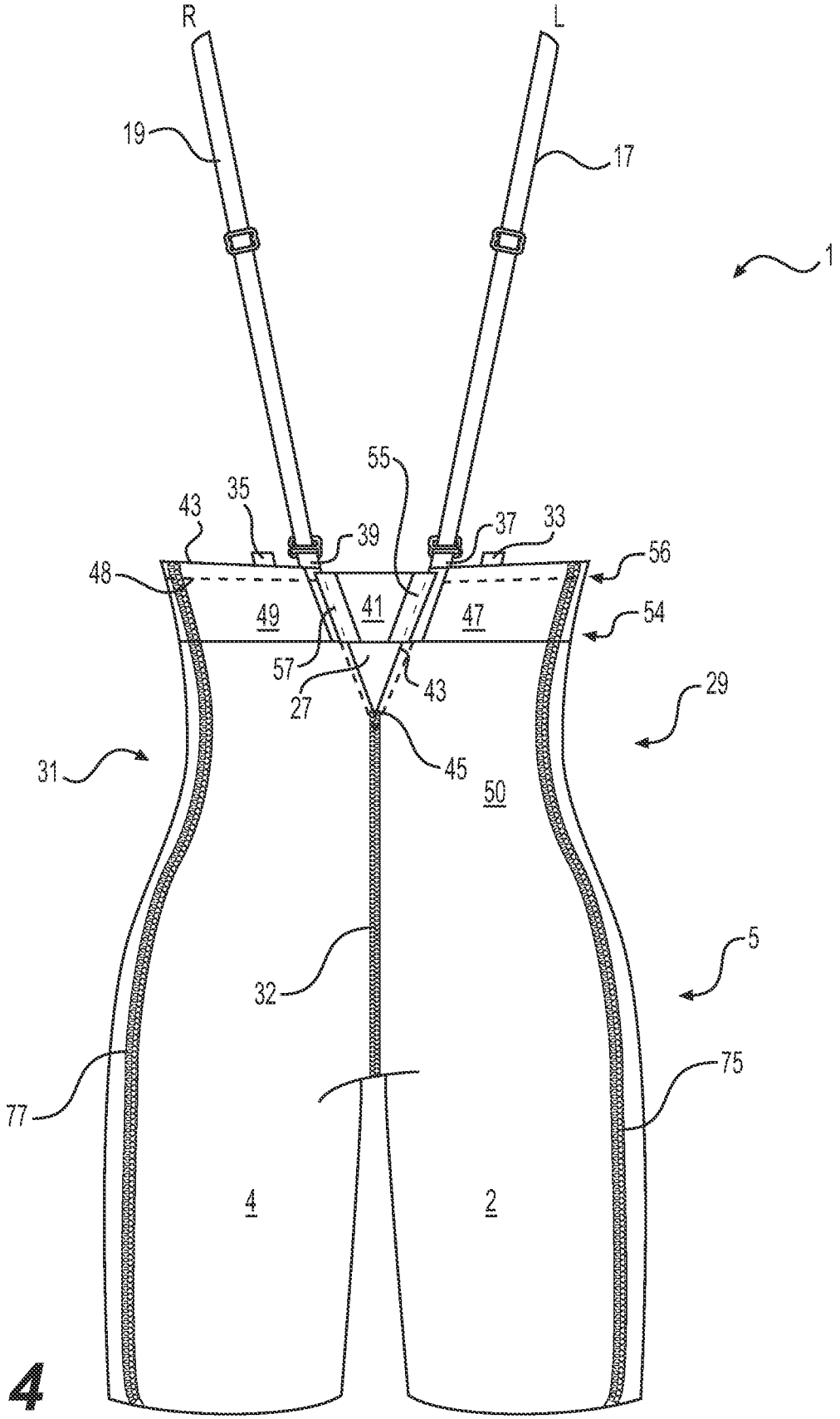
FIG. 4 illustrates a rear view of the inside of a shaping garment.

FIG. 3 shows the interior view of the front side of one embodiment of the shaping garment 1, as if the garment has been turned inside out. Left and right portions 47, 49 of an elastic band extend from the front side 3 to the rear side 5 of the shaping garment 1, as shown in FIG. 4. The elastic band serves to keep the shaping garment 1 in place on the wearer. It also increases comfort by stretching as the wearer moves, and provides a degree of fit flexibility to the garment 1. In the embodiment shown in FIG. 3, the left and right portions 47, 49 of the elastic band extend laterally along the front side 3 and are positioned inferior to the left and right breast supporting portions 13, 15. In this embodiment, the elastic band is positioned underneath the exterior-most layer of fabric 50 on both the front and rear sides 3, 5, such that it cannot be seen from the outside of the shaping garment 1. However, in other embodiments the elastic band could potentially form part of the exterior-most layer of fabric 50, either on the front side 3, the rear side 5, or both. While the elastic band of FIGS. 3 and 4 is divided into left and right portions 47, 49, in alternate embodiments the elastic band may remain undivided and extend fully across the front side 3. The height of the elastic band, from its inferior-most point to its superior-most point, is about 1.77 inches in the embodiment shown. However, in other embodiments the height of the elastic band can be from about 0.25 inches to about 4.00 inches. In still other embodiments, the height of the elastic band could be from about 0.25 inches to about 15.00 inches.

In the embodiment shown in FIGS. 3 and 4, the left and right portions 47, 49 of the elastic band are attached to the exterior-most layer of fabric 50, adjacent the front and rear superior edges 12, 43, with a lateral elastic band seam 48. The lateral elastic band seam 48 integrates the elastic band into the left and right front shaping regions 7, 9 and the left and right back shaping regions 29, 31 of the shaping garment 1. The lateral elastic band seam 48 extends laterally across a superior region 56 of the elastic band, whereas the inferior region 54 of the elastic band remains unattached. However, in other embodiments, the inferior region 54 can also be attached to the exterior-most layer of fabric 50. In the embodiment shown, lateral elastic band seam 48 is sewn to exterior-most layer of fabric using a zig-zag stitch. However, any number of stitch types that can stretch with the elastic band can be used to form lateral band seam 48. For example, other alternative stitch types could include, but are not limited to, a two or three needle bottom cover stitch, or a two or three needle top and bottom cover stitch. It is also possible to include one or more additional lateral band seams, such as the one shown as a dotted line and seen above seam 48 in FIG. 4.

Figure 13:
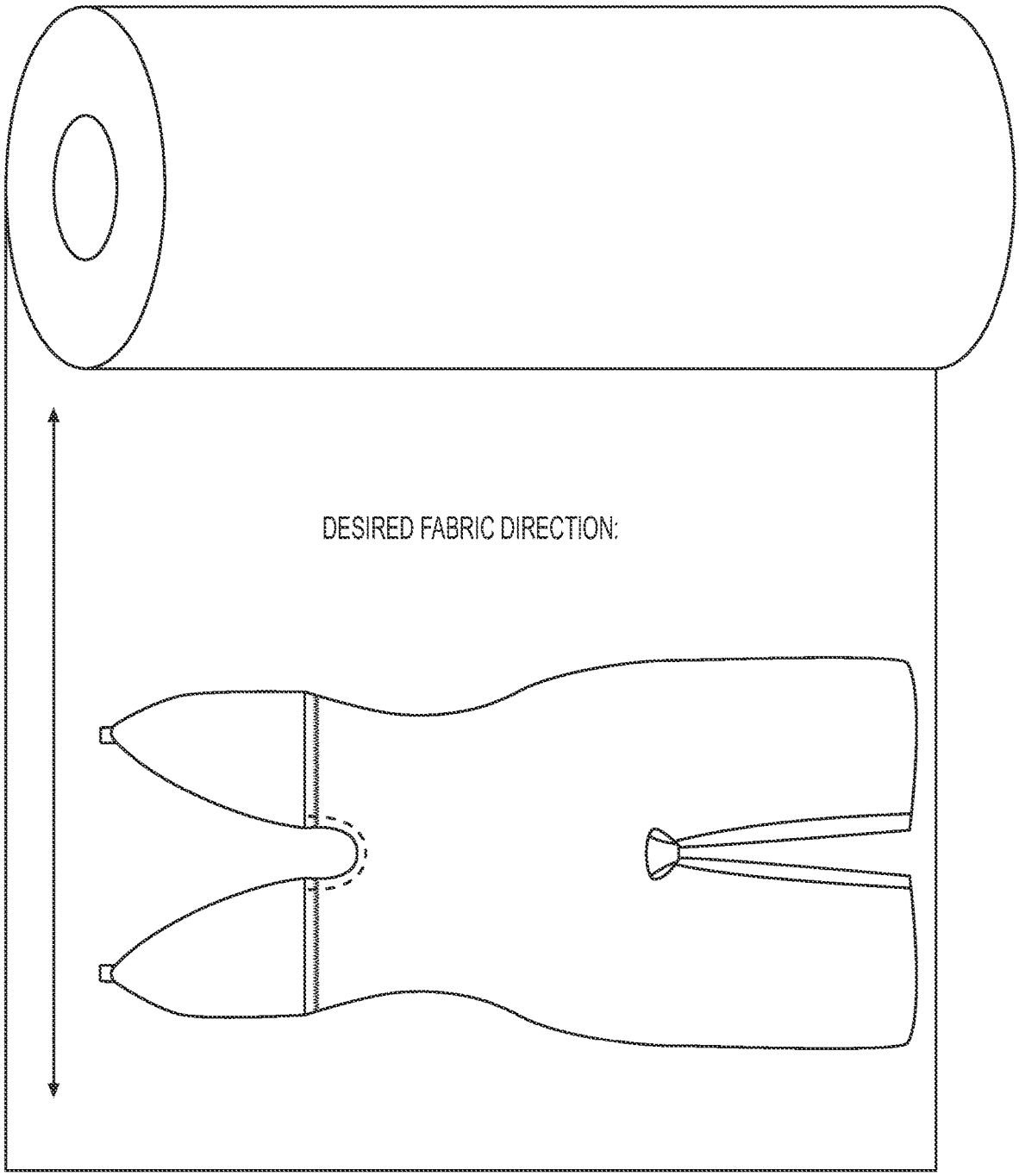
FIG. 13 illustrates the direction that the fabric of the exterior-most fabric can be cut.

In some embodiments, the exterior-most layer of fabric 50 can be formed of a knit material, for example, a warp knit material. In some embodiments, the exterior-most layer of fabric 50 is a tricot material. In some embodiments, the exterior-most layer of fabric 50 can be a microfiber material. In some embodiments, the exterior-most layer of fabric 50 can include nylon and elastane, for example, 49% nylon and 51% elastane. The outer component can, in some embodiments, be about 190 grams per square inch. The exterior-most layer of fabric 50 can be cut as shown in FIG. 13. For example, if the fabric is a knit fabric, the courses can be aligned lengthwise in a superior to inferior direction along the shaping garment 1.

Figure 5:
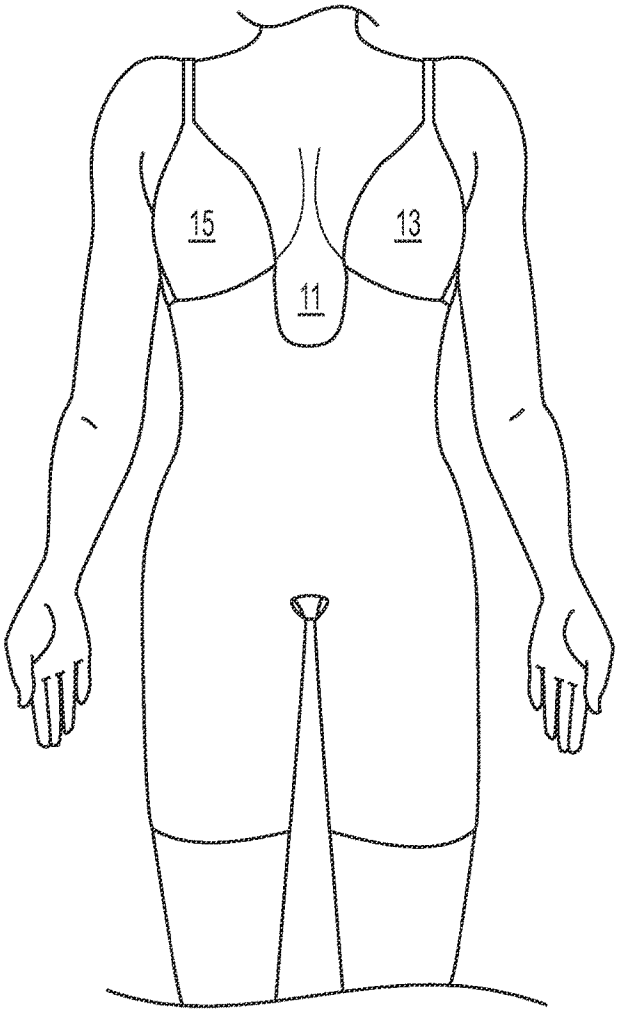
FIG. 5 illustrates a front view of the outside of a shaping garment on a wearer.
Figure 11:
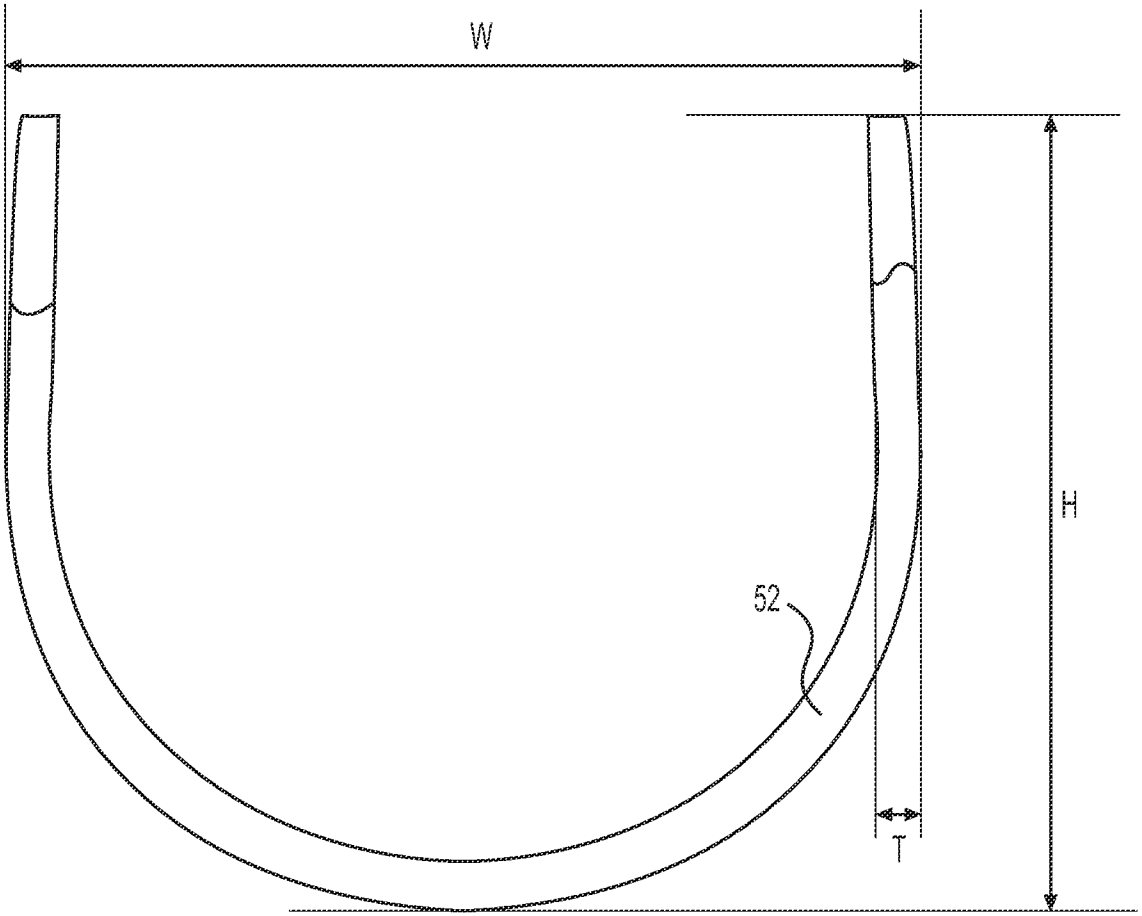
FIG. 11 illustrates a U-shaped wire.

In the embodiment shown in FIG. 3, the left portion 47 of the elastic band is affixed to a left side 51 of a U-shaped wire 52, and the right portion 49 of the elastic band is affixed to the right side 53 of the U-shaped wire 52. The U-shaped wire may be enclosed in a wire casing to facilitate its attachment to the shaping garment 1. The purpose of the U-shaped wire 52 is to provide additional breast support, limiting the amount that left and right breast supporting portions 13, 15 can move away from the U-shaped space 11 during wear. The shape of the U-shaped wire 52 is comfortable and gives the wearer many options for different plunging necklines by leaving a large portion of the lower chest exposed. FIG. 5 shows the front side 3 of the shaping garment 1 on a wearer. The U-shaped wire 52 enhances cleavage by limiting the extent that the wearer's breasts can separate (despite breast supporting portions 13, 15 not being directly attached to each other). The U-shaped wire is shown in greater detail in FIG. 11. The wire can be rectangular in cross section such that it will lay flat against the wearer's chest. Alternatively, the U-shaped wire 52 could be square, circular, or elliptical in cross section. The wire of the embodiment shown in FIG. 11 is about 0.13 inches thick, the thickness t being measured as the greatest distance between one side of the U-shaped wire 52 and the other side of the U-shaped wire 52. The height h of the U-shape made by the wire 52 is about 2.25 inches (from the inferior-most point of the U to the superior-most point of the U) and the width w of the U-shape made by the wire 52 is about 2.50 inches (from the left side of the U to the right side of the U). In other embodiments, the thickness of the wire 52 could range from 0.05 to 0.50 inches, the height of the U-shape could range from 0.50 to 4.00 inches, and the width of the U-shape could range from 0.5 to 4.00 inches.

Figure 6:
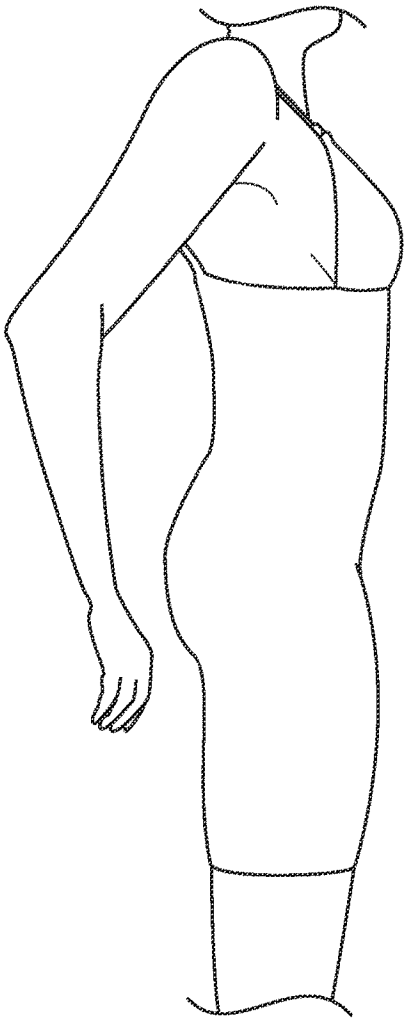
FIG. 6 illustrates a side view of the outside of a shaping garment on a wearer.

Left and right breast supporting portions 13, 15 can each include an inner breast cup and an outer breast cover. In some examples, the breast supporting portions 13, 15 can also include a strip of supporting fabric at the lateral sides of the breast supporting portions 13, 15. The strip of supporting fabric can be positioned between an inner, foam cup and the outer layer of fabric, remaining hidden to the wearer. The strip of supporting fabric increases the rigidity of the lateral sides of breast supporting portions 13, 15, to prevent it from stretching and to provide additional breast support during wear, as shown in the side view of the shaping garment 1 on a wearer in FIG. 6.

FIG. 4 shows the interior view of the rear side of one embodiment of the shaping garment 1, as if the garment has been turned inside out. Removable back adjuster 41 is shown adjoining the left and right back shaping regions 29, 31 and bridging the space 27. In the embodiment shown, the left portion 47 of the of the elastic band attaches to the left side 55 of the removable back adjuster, and the right portion 49 of the elastic band attaches to the right side 57 of the removable back adjuster.

FIG. 10 is an exterior view showing additional detail of an example embodiment of a removable back adjuster 41 and the left and right closure mechanisms, 59, 61. In this embodiment, a portion of each of the left and right closure mechanisms 59, 61 is located on the removable back adjuster 41, whereas the corresponding portion of each of the left and right closure mechanisms 59, 61 is located on the left and right portions 47, 49 of the elastic band, enabling the removable back adjuster 41 to be attached to the left and right portions 47, 49 of the elastic band. In this embodiment, the left and right closure mechanisms comprise hooks 63 and eyes 65. The eyes 65 are positioned on the left and right portions 47, 49 of the elastic band, and the hooks 63 are positioned on both the left and right exterior sides of the removable back adjuster 41, curving outward and away from the wearer. However, the hooks and eyes could take any variety of positions and orientations, so long as they serve to attach the removable back adjuster 41 to the left and right back shaping regions 29, 31 of the shapewear garment 1. Furthermore, the left and right closure mechanisms could comprise any of a known variety of closure mechanisms, including, but not limited to snaps, ribbon ties, zippers, hook and loop fasteners (such as Velcro®), buttons and/or one or more slidable hook fasteners. A slidable hook fastener includes a slidable hook that lays generally flat against the wearer's body. The slidable hook can attach to an elongated loop or, in some embodiments, to another slidable hook fastener.

Referring still to FIG. 10, a highly elastic region 67 is positioned between the portions of the left and right closure mechanisms 59, 61 located on the removable back adjuster 41. In the embodiment shown, the highly elastic region 67 can be approximately the same height as the left and right portions 47, 49 of the elastic band. The highly elastic region 67 may be formed of the same material as the elastic band. However, in other embodiments the highly elastic region 67 of the removable back adjuster 41 can be a different height and/or a different material that the left and right portions 47, 49 of the elastic band. The height h of the highly elastic region 67 can be, for example, from about 0.25 inches to about 4.00 inches. In the embodiment shown, the width w of the back adjuster 41, from the left-most point to the right-most point, is about 2.50 inches. However, the width can range anywhere from about 0.50 to about 5.00 inches.

Methods of making the shaping garment 1 are also disclosed. The method of making can include cutting a left rear panel 69 from a fabric sheet such that the left rear panel 69 narrows as it extends toward a superior portion of the left rear panel to create a narrowing left superior rear portion, and cutting a right rear panel 71 from a fabric sheet such that the right rear panel 71 narrows as it extends toward a superior portion of the right rear panel to create a narrowing right superior rear portion. The method can further include attaching a portion of a left closure mechanism 59 to the right edge of the narrowing left superior rear portion, and and attaching a portion of a right closure mechanism 61 to the left edge of the narrowing right superior rear portion. The right inferior edge of the left rear panel 69 can be sewn to a left inferior edge of the right rear panel 71 to form a rear side 5 of the shaping garment. The narrowing left superior rear portion and the narrowing right superior rear portion can remain unattached, thereby defining the space 27 in the rear side 5 of the shaping garment 1. The joining of the left and right rear panels form a central back seam 32. In some examples, central back seam 32 can be formed using an overlock stitch. However, any variety of stitch types can be used to form the central back seam. The method can also include sewing the rear side 5 of the shaping garment to a front panel 73 to form left and right side seams 75, 77 and a front side 3 of the shaping garment 1. Some embodiments of the methods of making the shaping garment 1 can include attaching a removable back adjuster 41 to the left and right closure mechanisms 59, 61, to bridge the space 27.

Some methods can include attaching at least one elastic band along an interior, superior edge 43 of the rear side 5 of the shaping garment 1. For example, a left portion 47 of an elastic band can be extended from the interior, rear side 5 of the shaping garment 1 to the front side 3 of the shaping garment 1, and a right portion 49 of an elastic band can be extended from the interior, rear side 5 of the shaping garment 1 to the front side 3 of the shaping garment 1. The left and right portions 47, 49 of the elastic band can be attached to a U-shaped wire 52 on the front side 3 of the shaping garment 1. The methods can also include attaching a left facing elastic to the right edge of the narrowing left superior rear portion and attaching a right facing elastic to the left edge of the narrowing right superior rear portion.

In some embodiments, the left and right breast supporting portions 13, 15 can be constructed as follows. A first layer of foam is covered (flat) on a top side with a first layer of fabric and on a bottom side with a second layer of fabric. The first and second fabric layers are bonded or laminated to the layer of foam. The foam surrounded by the first and second fabric layers is then molded with heat to the shape of the cup. A third, outer layer of fabric is molded separately, then sewn to the front of the cup. In some embodiments, fabrics used in cup construction are able to withstand high temperatures and take the shape of the mold while remaining pliable. In some embodiments, a strip of supporting fabric can be positioned between the layers, at the lateral sides of the breast supporting portions 13, 15.

In some embodiments of the methods, left and right breast supporting portions 13, 15 can be attached along a superior edge 12 of the front side 3 of the shaping garment 1. A superior region 56 of the elastic band or superior regions 56 of the left and right portions 47, 49 of the elastic band can be attached to an interior, superior edge 12 of the front panel 73 and to the inferior edges of the left and right breast supporting portion 13, 15. Finally, a superior edge 12 of the front panel 73 can be attached to a U-shaped wire 52 or to a casing that encloses the U-shaped wire 52. The U-shaped wire 52 or the casing that encloses the U-shaped wire 52 can be attached the left and right elastic band portions 47, 49 and to the left and right breast supporting portions 13, 15.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The implementation was chosen and described in order to best explain the principles of the invention and the practical application, and to enable others of ordinary skill in the art to understand the invention for various implementations with various modifications as are suited to the particular use contemplated.

The invention claimed is:

1. A shaping garment comprising;

a front side and a rear side, a breast supporting portion positioned on the front side, a superior edge comprising a rear lowermost area positioned on the rear side, wherein the superior edge diverges extending upward from the rear lowermost area to define an angular space that separates the rear side into a narrowing left superior rear portion and a narrowing right superior rear portion, and further comprising a left shoulder strap tab coupled to a left portion of the superior edge adjacent the angular space and a right shoulder strap tab coupled to a right portion of the superior edge adjacent the angular space.

2. The shaping garment of claim 1, wherein the shaping garment comprises a low back mode and an ultra low back mode.

3. The shaping garment of claim 2, wherein in the low back mode the shaping garment comprises a back adjuster bridging the angular space and removably coupled to each of the narrowing left and right superior rear portions, and wherein removal of the back adjuster converts the garment from the low back mode to the ultra low back mode.

4. The shaping garment of claim 1, further comprising a left shoulder strap and a right shoulder strap, the left shoulder strap being removably coupled to the left shoulder strap tab and the right shoulder strap being removably coupled to the right shoulder strap tab, wherein the left shoulder strap and the right shoulder strap extend the angular space in a superior direction.

5. The shaping garment of claim 1, further comprising a facing elastic coupled along the superior edge adjacent the angular space.

6. A shaping garment comprising;

a rear side, a front side comprising a left breast supporting portion and a right breast supporting portion, a superior edge region of the front side extending along medial edges of the left breast supporting portion and the right breast supporting portion, the superior edge region coupled to a central U-shaped structure below and between the left and right breast supporting portions, left and right interior elastic band portions, the left interior elastic band portion coupled to the left breast supporting portion and a left side of the U-shaped structure, and the right interior elastic band portion coupled to the right breast supporting portion and a right side of the U-shaped structure, and an exterior layer of fabric coupled to and extending over the left and right interior elastic band portions, the exterior layer of fabric further coupled to the left breast supporting portion, a left side of the U-shaped structure, the right breast supporting portion, and a right side of the U-shaped structure, wherein the exterior layer of fabric is coupled to the left interior elastic band portion by a left elastic band seam, and wherein the exterior layer of fabric is coupled to the right interior elastic band portion by a right elastic band seam.

7. The shaping garment of claim 6, wherein the left elastic band seam extends laterally along a top edge region of the left interior elastic band portion, and the right elastic band seam extends laterally along a top edge region of the right elastic band portion.

8. The shaping garment of claim 7, wherein a bottom region of the left interior elastic band portion is unattached to the exterior layer of fabric, and a bottom region of the right interior elastic band portion is unattached to the exterior layer of fabric.

9. The shaping garment of claim 6, wherein the left and right interior elastic band portions extend to the rear side and partially define a superior edge region of the rear side.

10. The shaping garment of claim 9, wherein the exterior layer of fabric is coupled to the left and right interior elastic band portions on the rear side of the garment.

11. The shaping garment of claim 6, wherein the U-shaped structure comprises a casing, and the casing is coupled to the left and right breast supporting regions, the left and right interior elastic band portions, and the exterior layer of fabric.

12. The shaping garment of claim 11, wherein the U-shaped structure comprises a U-shaped wire enclosed in the casing.

13. The shaping garment of claim 6, wherein the left and right breast supporting portions each comprise a molded breast cup.

14. A method of making a shaping garment, the method comprising;

cutting a left rear panel from a fabric sheet such that the left rear panel narrows as it extends toward a superior portion of the left panel to create a narrowing left superior rear portion, cutting a right rear panel from a fabric sheet such that the right rear panel narrows as it extends toward a superior portion of the right panel to create a narrowing right superior rear portion, sewing a right inferior edge of the left rear panel to a left inferior edge of the right rear panel to form a rear side of the shaping garment, wherein the narrowing left superior rear portion and the narrowing right superior rear portion remain unattached to define an angular space in the rear side of the shaping garment, and sewing the rear side of the shaping garment to a front panel to form a front side of the shaping garment.

15. The method of claim 14, further comprising coupling a left facing elastic along a right edge of the narrowing left superior rear portion and coupling a right facing elastic along a left edge of the narrowing right superior rear portion.

16. The method of claim 14, further comprising attaching at least one elastic band along an interior, superior edge of the rear side of the shaping garment and coupling the at least one elastic band to a U-shaped structure, wherein the U-shaped structure is disposed on the front side of the shaping garment.

17. The method of claim 14, further comprising attaching a portion of a left closure mechanism to a right edge of the narrowing left superior rear portion.

18. The method of claim 17, further comprising attaching a portion of a right closure mechanism to a left edge of the narrowing right superior rear portion.

19. The method of claim 18, further comprising providing a removable back adjuster and attaching the removable back adjuster to the left and right closure mechanisms to bridge the angular space in the rear side of the shaping garment.

* * * * *